US006817365B2

(12) United States Patent
Hajaligol et al.

(10) Patent No.: US 6,817,365 B2
(45) Date of Patent: Nov. 16, 2004

(54) CIGARETTE PAPER HAVING HEAT-DEGRADABLE FILLER PARTICLES, AND CIGARETTE COMPRISING A CIGARETTE PAPER WRAPPER HAVING HEAT-DEGRADABLE FILLER PARTICLES

(75) Inventors: Mohammad Hajaligol, Midlothian, VA (US); W. Geoffrey Chan, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 09/987,735

(22) Filed: Nov. 15, 2001

(65) Prior Publication Data

US 2003/0089377 A1 May 15, 2003

(51) Int. Cl.[7] ..... D21F 11/00; D21H 11/00
(52) U.S. Cl. ..... 131/360; 131/365; 162/139
(58) Field of Search ..... 131/360, 365; 162/139

(56) References Cited

U.S. PATENT DOCUMENTS

| | | | | |
|---|---|---|---|---|
| 2,754,828 A | | 7/1956 | Swain | |
| 2,992,647 A | | 7/1961 | Figge | |
| 3,473,535 A | | 10/1969 | Stahly | |
| 3,511,247 A | | 5/1970 | Tamol | |
| 3,526,904 A | * | 9/1970 | Tamol | 131/336 |
| 3,545,448 A | | 12/1970 | Troon et al. | |
| 3,667,479 A | | 6/1972 | Sanford et al. | |
| 3,699,972 A | | 10/1972 | Frisch | |
| 3,699,973 A | | 10/1972 | Tamol et al. | |
| 3,805,799 A | * | 4/1974 | Stewart et al. | 131/336 |
| 3,828,801 A | | 8/1974 | Merrill | |
| 3,885,574 A | | 5/1975 | Borthwick et al. | |
| 3,943,942 A | | 3/1976 | Anderson et al. | |
| 4,008,723 A | | 2/1977 | Borthwick et al. | |
| 4,019,520 A | | 4/1977 | Strubel et al. | |
| 4,119,104 A | | 10/1978 | Roth | |
| 4,548,677 A | | 10/1985 | Schneider et al. | |
| 4,572,219 A | | 2/1986 | Gaisch et al. | |
| 4,590,955 A | | 5/1986 | Dixit | |
| 4,607,647 A | * | 8/1986 | Dashley et al. | 131/365 |
| 4,784,164 A | | 11/1988 | Adams et al. | |
| 4,865,055 A | | 9/1989 | Belvederi | |
| 5,062,434 A | | 11/1991 | Aulbach et al. | |
| 5,105,837 A | * | 4/1992 | Barnes et al. | 131/365 |
| 5,178,166 A | | 1/1993 | Newsome et al. | |
| 5,322,075 A | | 6/1994 | Deevi et al. | |
| 5,591,368 A | | 1/1997 | Fleischhauer et al. | |
| 5,878,754 A | * | 3/1999 | Peterson et al. | 131/365 |
| 5,909,736 A | | 6/1999 | Stavridis et al. | |
| 5,934,289 A | | 8/1999 | Watkins et al. | |
| 6,053,176 A | | 4/2000 | Adams et al. | |

OTHER PUBLICATIONS

Written Opinion for PCT/US02/36440 dated Nov. 18, 2003.
Notification of Transmittal of International Preliminary Examination Report for PCT/US02/36440 dated Apr. 9, 2004.
Notification of Transmittal of the International Search Report or the Declaration dated Feb. 7, 2003 for PCT/US02/36440.

* cited by examiner

*Primary Examiner*—Steven P. Griffin
*Assistant Examiner*—Carols Lopez
(74) *Attorney, Agent, or Firm*—Burns, Doane, Swecker & Mathis, LLP

(57) ABSTRACT

A cigarette paper includes heat-degradable filler particles to increase the porosity of the cigarette paper during smoking of the cigarette. The porosity of the cigarette paper during smoking of the cigarette will typically be from about 30% to abut 60%. The heat-degradable filler particles are capable of being dissipated at temperatures from about 25° C. to about 350° C. and/or at distances from about 0.1 mm to about 10 mm in advance of a charline formed in the cigarette paper during combustion of the cigarette. Methods of making the cigarette paper, a cigarette using the cigarette paper, and methods for making and smoking such a cigarette are also provided.

53 Claims, No Drawings

CIGARETTE PAPER HAVING HEAT-DEGRADABLE FILLER PARTICLES, AND CIGARETTE COMPRISING A CIGARETTE PAPER WRAPPER HAVING HEAT-DEGRADABLE FILLER PARTICLES

FIELD OF INVENTION

The invention relates to a cigarette paper and a cigarette for reducing the amount of unwanted byproducts in mainstream smoke during smoking of the cigarette, as compared to a conventional cigarette. More particularly, the invention relates to a cigarette paper having heat-degradable filler particles, and a cigarette comprising a cigarette paper wrapper having heat-degradable filler particles. The heat-degradable filler particles are capable of being dissipated during smoking of the cigarette to increase the porosity in an annular zone of the cigarette paper.

BACKGROUND

Various cigarette designs for reducing the amounts of unwanted byproducts and/or lowering the combustion temperature of a cigarette during smoking of the cigarette have been described in the art. A variety of unwanted byproducts may be contained in cigarette smoke, such as polynuclear aromatic hydrocarbons (PAHs), various heterocyclic compounds, hydrogen cyanide (HCN), nitric oxides ($NO_x$), carbon monoxide (CO), and other components of tar. Generally, higher combustion temperatures promote formation of these unwanted byproducts. Techniques known in the art, such as normal dilution, filtration, or selective filtration are not completely satisfactory for reducing unwanted byproducts in mainstream smoke.

For example, cigarettes having perforations in the wrapper for increasing air dilution have been described. U.S. Pat. No. 5,062,434 discloses a cigarette paper with a plurality of rows of perforations and U.S. Pat. No. 4,865,055 relates to a ventilated cigarette of uniform flavor. Additionally, U.S. Pat. No. 5,178,166 relates to a filter cigarette with a filter portion comprising a fluted tubular extrusion, as well as a porous wrapper comprising a longitudinal band of perforations to dilute the mainstream cigarette smoke with outside air. Another strategy for diluting the mainstream cigarette smoke is described in U.S. Pat. No. 4,548,677, which relates to a cigarette paper having a pore structure which is said to greatly promote diffusion, especially of carbon monoxide. However, one of the problems with perforated cigarettes is a lack of control over the level of air dilution, which can lead to a cigarette that may be considered tasteless and/or unsatisfactory to a smoker.

For better control over air dilution, cigarettes having perforations filled with a material that melts or sublimes during smoking of the cigarette have been described in the patent literature. For instance, U.S. Pat. No. 2,992,647 discloses a thermostatically controlled cigarette, having openings that have been filled with a material of low melting or vaporizing point that will melt or sublime as the cigarette is smoked, thus opening up the holes some distance in advance of the charline. The materials used to fill the holes in the '647 Patent include polyethylene, cellulose, monosodium phosphate, and menthol. Similarly, U.S. Pat. No. 3,511,247 discusses a smoking product with ventilation holes adapted to open during smoking to provide smoke diluted by air. The holes or perforations in the wrapper may be filled or covered with a substance (e.g. cellular materials such as ethyl cellulose) that is disintegrated by the heat generated by the burning of the tobacco in the cigarette. Also, U.S. Pat. No. 3,473,535 discloses a cigarette with holes that are sealed with a fusible material, and which open up about 1 cm behind the burning zone. Examples of fusible materials include waxes, such as paraffin, tallow, or stearin.

Various materials have been disclosed for filling perforations in the cigarette wrapper. For example, U.S. Pat. No. 3,699,973 discloses a film covering for a smoking product wrapper with apertures, which is either porous or deliberately perforated with vents or apertures. The openings or vents are covered with a polymeric film that has been treated using processes such as degradation, to expedite the removal of film over the apertures by smoke components, so that air is permitted to dilute the smoke during the latter stages of smoking. In another example, U.S. Pat. No. 4,784,164 relates to tobacco rod wrappers and compositions for their production. The wrappers have porosity apertures which are partially or fully blocked by a coating of a heat-removable, porosity-reducing composition. The heat-removable, porosity-reducing composition comprises materials such as palmitates, which melt as the burning tip of the smoking rod approaches, thus increasing the porosity of the wrapper. However, an overall disadvantage to all of these techniques is that creating and filling the perforations typically require additional manufacturing steps and/or special equipment.

Another approach for effecting air dilution of mainstream smoke is described in U.S. Pat. No. 2,754,828, which discloses a cigarette having a form-retaining non-combustible wrapper adapted to hold the ash as the cigarette is smoked. The wrapper has apertures that permit air to enter in order to support the burning of the tobacco and to provide ventilation to cool the hot gases or air before being drawn into the mouth of the smoker. The apertures are filled with a readily combustible material, such as cellulose fibers, which permits the wrapper to become porous or apertured by the heat generated during the burning of the tobacco.

Yet another strategy for promoting air dilution of mainstream smoke has been to treat the cigarette paper wrapper with burn control agents. For instance, U.S. Pat. No. 3,667,479 and U.S. Pat. No. 3,699,972 disclose a cigarette with a modified paper wrapper. The wrapper is treated in pre-selected areas with a burn control additive or a burn accelerating agent over a pre-selected area of the cigarette paper wrapper. When the burning coal reaches the area of treatment during smoking of the cigarette, the treated area is burned away, creating an aperture and allowing the passage of air.

Another method for treating the cigarette wrapper is discussed in U.S. Pat. No. 4,590,955. The '955 Patent describes adding a non-ionic surfactant to the cigarette paper wrapper, which is said to reduce the amount of carbon monoxide produced upon burning the wrapper during smoking.

Other approaches to reduce the amount of unwanted byproducts in cigarette smoke include various filtering techniques. For example, U.S. Pat. No. 3,828,801 relates to a filter for removing polynuclear aromatic hydrocarbons from tobacco smoke using polysiloxane compositions located in the filter section of a tobacco smoking device in admixture with an endothermically dissociable hydrate or carbonate filler. In another example, U.S. Pat. No. 5,909,736 describes methods for removal of unwanted compounds from cigarette smoke using biological substances, such as metal ions ($Fe^{+2}$, $Cu^{+2}$, $Mg^{+2}$) complexed with porphirin rings, as well as $Fe^{+2}$ ions sterospecifically bound to protein molecules.

Despite all of the developments in the art to date, there remain various disadvantages to each of the above techniques. For instance, many of these techniques require additional manufacturing steps, as well as special equipment for processing the cigarette paper wrapper or the cigarette, which may lead to additional expense and/or slower cigarette production. Thus, an economical manufacturing technique for making cigarettes designed to reduce unwanted byproducts and/or lowering the combustion temperature in a cigarette would be advantageous. Preferably, such a cigarette would not require additional processing steps for perforating the cigarette or cigarette paper, or filling the perforations.

SUMMARY

The invention relates to a cigarette paper having heat-degradable filler particles, as well as a cigarette comprising a cigarette paper wrapper having heat-degradable filler particles. The heat-degradable filler particles are capable of being dissipated during smoking of the cigarette to increase the porosity of the cigarette paper wrapper.

In a preferred embodiment of the invention, the heat-degradable filler particles are dissipated during smoking of the cigarette to increase the porosity of the cigarette paper wrapper to a final porosity from about 30% to about 60%. In yet another preferred embodiment, the invention produces a cigarette with the air dilution from about 30 percent to about 90 percent. Preferably, the combustion temperature in a cigarette according to the invention, is maintained at or near the smouldering temperature of the tobacco rod during smoking. In a preferred embodiment, the combustion temperature of the cigarette during smoking of the cigarette is maintained at about 600° C. to about 750° C.

Preferably, the heat-degradable filler particles are capable of being dissipated at a temperature from about 25° C. to about 350° C., more preferably from about 100° C. to about 350° C., and most preferably from about 200° C. to about 350° C. In one embodiment of the invention, the heat-degradable filler particles comprise materials based on cellulose. For instance, the heat-degradable filler particles may comprise an alkyl cellulose, an ethyl cellulose, a cellulose propionate, a cellulose butyrate, a mixed ester of a cellulose, or mixtures thereof. Other suitable materials for the heat-degradable filler particles include various inorganic and polymeric materials. For example, materials such as monosodium phosphate, disodium phosphate, carnauba, polyethylene oxide, vinyl acetate, polymethacrylate, nitrocellulose, ethylene vinyl acetate, and mixtures thereof may also be used. Particularly preferred materials include ethyl cellulose, monosodium phosphate, or mixtures thereof.

In a preferred embodiment, the heat-degradable filler particles are dissipated at a distance from about 0.1 mm to about 10 mm in advance of a charline, wherein the charline is formed in the cigarette paper during smoking of the cigarette. In a more preferred embodiment, the heat-degradable filler particles are dissipated at a distance from about 0.5 mm to about 2 mm in advance of the charline. Preferably, the heat-degradable filler particles typically have a mean average particle size ranging from about one quarter the thickness of the paper to about one and a half times the thickness of the paper. For instance, in a preferred embodiment, the mean average particle size is from about 0.2 mm to about 0.5 mm in size.

A method of making a cigarette paper having heat-degradable filler particles as described above, is also provided. The method comprises adding the heat-degradable filler particles to a feedstock of a cigarette paper making machine.

A method of making a cigarette is also provided, comprising (i) providing a cut filler to a cigarette making machine to form a tobacco rod; and (ii) placing a paper wrapper around the tobacco rod to form the cigarette, wherein the cigarette paper comprises heat-degradable filler particles, and wherein said heat-degradable filler particles are capable of being dissipated during smoking of the cigarette to increase the porosity of the cigarette paper wrapper. Methods for smoking the described cigarette are also provided, comprising lighting the cigarette to form smoke and inhaling the smoke, wherein during the smoking of the cigarette, the heat-degradable filler particles are dissipated during smoking of the cigarette to increase the porosity of the cigarette paper wrapper.

DETAILED DESCRIPTION

The invention provides a cigarette paper comprising heat-degradable filler particles, as well as a cigarette comprising a cigarette paper wrapper having heat-degradable filler particles, wherein said heat-degradable filler particles are capable of being dissipated when the cigarette is smoked, to increase the porosity of the cigarette paper. Methods of making the cigarette paper, methods of making the cigarette, as well as methods of smoking the cigarette are also provided. However, prior to describing this invention in further detail, the following terms will first be defined:

By "dissipated" is meant melting, vaporizing and/or subliming during smoking of the cigarette.

"Smoking" of a cigarette means the heating or warming of the cigarette to form smoke and/or vapors, which are inhaled. Generally, smoking of a cigarette involves lighting one end of the cigarette and inhaling the smoke and/or vapors produced through the mouth end of the cigarette, while the tobacco contained in the cigarette undergoes a combustion reaction. However, the cigarette may also be smoked by other means. For example, the cigarette may be smoked by heating the tobacco to generate smoke and/or heating the tobacco using electrical heater means, as described in commonly-assigned U.S. Pat. Nos. 6,053,176; 5,934,289; 5,934,289, 5,591,368 or 5,322,075, for example.

The "charline" is the line created in a cigarette paper wrapper at the edge of the burning zone of the cigarette, produced during smoking of the cigarette.

The "coal" is the burning zone of the cigarette, produced during smoking of the cigarette. The coal is usually at the lit end of a cigarette. The coal is generally where most of the unwanted byproducts are formed, e.g. light gases and some components of tar. The coal is also sometimes referred to as the combustion zone.

The "combustion temperature" refers to the temperature of the coal during smoking of the cigarette. Higher combustion temperatures promote the formation of certain compounds, and also increase the amount of certain compounds produced.

When referring to the "porosity" of the cigarette paper, porosity refers to the area of paper surface that is open, relative to the total surface area, expressed as a percentage.

The term "mainstream" smoke refers to the mixture of gases passing down the tobacco rod and issuing through the filter end, i.e. the amount of smoke issuing or drawn from the mouth end of a cigarette during smoking of the cigarette. The mainstream smoke contains smoke that is drawn in through both the lit end or the coal, as well as through the cigarette paper wrapper.

The term "air dilution" is the ratio (generally expressed as a percentage) of the volume of air drawn through the paper wrapper to the total volume of air and smoke drawn through the cigarette tip end and exiting through the butt end. Air dilution refers to the dilution of mainstream smoke with air from the atmosphere, and is affected by the porosity of the paper and/or perforations in the paper.

The invention provides a cigarette with heat-degradable filler particles in the cigarette paper wrapper, which are dissipated in advance of the charline to increase the porosity of the cigarette paper wrapper, and thereby increase the amount of air drawn in from behind the charline. The invention thus provides a way to regulate and reduce the combustion temperature of the cigarette during smoking, which decreases the types and amounts of certain unwanted byproducts that are formed.

While not wishing to be limited by theory, it is believed that when taking a puff on a lit cigarette, according to the invention, air enters preferentially through the cigarette paper wrapper, rather than through the coal, thereby increasing the air flow behind the charline. As a result, the amount of air and oxygen entering through the coal is decreased, which in turn decreases the temperature of the coal. As an additional benefit, it is believed that by promoting the introduction of air from behind the charline, rather than through the coal, the amount of unwanted byproducts carried in the mainstream smoke from the coal to the smoker's mouth is also be decreased.

The heat-degradable filler particles are typically incorporated as fillers into the cigarette paper during the papermaking process. When the cigarette paper is used as a cigarette paper wrapper for a cigarette, the heat-degradable filler particles have the ability to dissipate when the cigarette is smoked. The size, shape, concentration and materials for the heat-degradable filler particles should be selected to sufficiently increase the porosity of the cigarette paper to permit air to enter during smoking of the cigarette from behind the charline. In a preferred embodiment, the heat-degradable filler particles are capable of being dissipated during smoking of a cigarette to increase the porosity of the cigarette paper wrapper to a final porosity from about 30% to about 60%, and preferably from about 40% to about 50%. In a preferred embodiment, the heat-degradable filler particles are dissipated in an annular zone of the cigarette paper in advance of the charline, and preferably the porosity of the paper is substantially uniform in an annular zone of the cigarette paper in advance of the charline.

The porosity of the cigarette paper wrapper should provide the desired amount of air dilution. In an embodiment of the invention, the heat-degradable filler particles are dissipated during smoking of the cigarette to provide air dilution of at least 30 percent, preferably from about 30 percent to about 90 percent, preferably from about 30 percent to about 80 percent, and most preferably from about 30 percent to about 70 percent. If the air dilution is too high, then the cigarette will not have the desired flavor. Thus, the air dilution will preferentially be selected to achieve the desired result, while maintaining desirable flavor properties.

As mentioned previously, the invention provides a way to control the combustion temperature of the cigarette, e.g. by controlling the porosity and/or air dilution. Preferably, the combustion temperature of the cigarette is reduced, thereby decreasing the amount of unwanted byproducts that are produced and/or ingested by the smoker. In a preferred embodiment, the combustion temperature of the cigarette during smoking of the cigarette is maintained at about 600° C. to about 750° C., and more preferably from about 650° C. to about 700° C., or even lower.

Preferably, the heat-degradable filler particles are capable of being dissipated at a temperature from about 25° C. to about 350° C., preferably from about 100° C. to about 350° C., and most preferably from about 200° C. to about 350° C. The upper temperature limit should generally remain below the paper burn temperature of the cigarette paper. Typically, the burn temperature is approximately 400–450° C. for most cigarette paper. However, depending upon the burn temperature of the paper, the dissipation temperature should be adjusted accordingly.

The heat-degradable filler particles comprise materials that can be dissipated within the desired temperature range and distance from the charline. Also, the heat-degradable filler particles preferably do not impart any unwanted odor or flavor to the cigarette. Thus, the heat-degradable filler particles may comprise any suitable organic or inorganic compound, which is capable of dissipating to increase the porosity of the cigarette paper wrapper in a cigarette under conditions where the cigarette is smoked.

For example, cellulose and cellulose-based materials may be used for the heat-degradable filler particles. Cellulose is a natural carbohydrate polysaccharide consisting of anhydroglucose units joined by an oxygen linkage to form long molecular chains. The cellulose may be chemically modified, i.e. one or more chemical groups (such as carboxyl, alkyl, acetate, nitrate, ether, etc.) may be substituted for one or more of the hydroxyl groups along the carbon chain of cellulose. The heat-degradable filler particles may comprise, for example, an alkyl cellulose, an ethyl cellulose, cellulose acetate, a cellulose propionate, a cellulose butyrate, a mixed ester of a cellulose, or mixtures thereof.

In addition, a variety of inorganic and polymeric materials may also be used for the heat-degradable filler particles, such as but not limited to: monosodium phosphate, disodium phosphate, carnauba, polyethylene oxide, vinyl acetate, polymethacrylate, nitrocellulose, ethylene vinyl acetate, and mixtures thereof may also be used.

Particularly preferred materials include ethyl cellulose, monosodium phosphate, or mixtures thereof.

In an embodiment, the invention relates to a cigarette comprising a cigarette paper wrapper having heat-degradable filler particles, wherein said heat-degradable filler particles are capable of being dissipated at a distance of about 0.1 mm to about 10 mm in advance of the charline when the cigarette is smoked, and more preferably about 0.5 mm to about 2 mm. However, it should be recognized that increasing porosity of the cigarette paper too far in advance of the charline may dilute the smoke excessively. The relationship between melting points and vaporization points and the distance that the heat-degradable filler particles dissipate can be determined by routine experimentation, or by standard reference books. For instance, in a preferred embodiment, ethyl cellulose is used, which dissipates around 200° C. at a distance of about 2–3 mm behind the charline. For illustration and example purposes, substances that melt at around 50° C. typically dissipate at a distance of about 10–15 mm behind the charline, those that melt around 100° C. typically dissipate around 5–6 mm behind charline, those that melt around 150° C. typically dissipate around 4–5 mm behind the charline, those that melt around 200° C. typically dissipate around 3 mm behind the charline, those that melt around 250° C. typically dissipate around 2–3 mm behind the charline, and those that melt around 300° C. typically dissipate around 1 mm behind the charline.

The heat-degradable filler particles may be of any shape or mixture of shapes. For instance, they may be spheres, pellets, fibers, irregularly shaped particles, or any other shape. The heat-degradable filler particles may be of any size suitable for effectively increasing the porosity. The size of the heat-degradable filler particles depends upon the paper thickness, and may be selected to be close to or slightly larger than the thickness of the paper. Preferably, the heat-degradable filler particles have a mean average particle size from about one quarter the thickness of the paper to about one and a half times the thickness of the paper. If the heat-degradable filler particles are about the thickness of the paper or larger, then perforations or holes may be created in the cigarette paper wrapper during smoking of the cigarette. However, it is not necessary to create perforations or holes, as long as the porosity of the cigarette paper wrapper is sufficiently increased some distance in advance of the charline, to permit air to preferentially enter the cigarette paper at a desired distance from behind the charline.

Typically, the particles may be from about 0.05 mm to about 1 mm in size. Preferably, the heat-degradable filler particles are from about 0.2 mm to about 0.5 mm in size. However, the size of the heat-degradable filler particles depends upon the paper thickness, and is therefore adjusted accordingly. Typically, the cigarette paper is around 0.05 mm to about 0.5 mm in thickness, and preferably around 0.1 mm in thickness. According to the invention, the cigarette may comprise one or more cigarette paper wrapper layers, as long as the heat-degradable filler particles in the cigarette paper wrapper can be dissipated during smoking of the cigarette to increase the porosity of the cigarette paper.

The cigarette paper may be prepared using any known papermaking technique known in the art. The resulting cigarette wrapper may have a neutral taste or it can be specifically flavored. Generally, paper may comprise pulp and up to about 60% conventional cigarette paper filler materials. Preferably the heat-degradable filler particles are present in an amount that will provide the desired porosity during smoking of the cigarette, and may thus be adjusted accordingly. Typically, the total amount of heat-degradable filler particles present will range from an effective amount up to about 50% based on the total weight of the paper, preferably up to about 30% based on the total weight of the paper.

In addition to the heat-degradable filler particles, the paper may also comprise up to about 10% additives, and preferably up to about 5% of additives, such as burn modifiers. Such fillers are usually not dissipated under conditions for smoking the cigarette. Examples of cigarette paper fillers, included but are not limited to: calcium carbonate to increase combustion, magnesium carbonate to improve ash color, titanium oxide to whiten the ash, and potassium nitrate to give the ash greater adherence, for example. More specifically, examples of fillers include hydrates (e.g. $CaSO_4.2H_2O$), hydroxides (e.g. $Ca(OH)_2$), carbonates (e.g. $MgCO_3$, $CaCO_3$, $SrCO_3$, and $BaCO_3$), phosphates (e.g. Mg, Sr, Ca, and Ba), aluminates (e.g. Mg, Sr, Ca, and Ba), silicates (e.g. Mg, Sr, Ca, Ba, Na, and K), clays (e.g. attapulgite clay), and/or oxides (e.g. fumed silica, fumed alumina).

Burn modifier salts may also be included. Examples of burn modifier salts include the sodium or potassium salts of acids such as carbonic, formic, acetic, propionic, malic, lactic, glycolic, citric, tartaric, fumaric, oxalic, malonic, succinic and phosphoric. Other burn modifiers include propionic acid, carbonic acid, fumaric acid and glycolic acid. In a conventional cigarette, the burn modifier is present in an amount up to about 15 percent. However, as an additional benefit, the invention provides a cigarette paper which requires less burn promoter, or no burn promoter.

Techniques for cigarette manufacture are known in the art. Any modified or conventional cigarette making technique may be used to incorporate the cigarette paper having the heat-degradable fillers. The resulting cigarettes can be manufactured to any desired specification using standard or modified cigarette making techniques and equipment. Generally, the cigarettes of the invention range from about 50 mm to about 85 mm in length. Typically, a regular cigarette is about 70 mm long, a "King Size" is about 85 mm long, a "Super King Size" is about 100 mm long, and a "Long" is usually about 120 mm in length. The circumference is from about 15 mm to about 30 mm in circumference, with around 25 mm being a typical circumference.

Any suitable tobacco mixture may be used for the cut filler. Examples of suitable types of tobacco materials include flue-cured, Burley, Md. or Oriental tobaccos, the rare or specialty tobaccos, and blends thereof. The tobacco material can be provided in the form of tobacco lamina; processed tobacco materials such as volume expanded or puffed tobacco, processed tobacco stems such as cut-rolled or cut-puffed stems, reconstituted tobacco materials; or blends thereof. The invention may also be practiced with tobacco substitutes.

The tobacco is normally employed in the form of cut filler, i.e. in the form of shreds or strands cut into widths ranging from about 1/10 inch to about 1/20 inch or even 1/40 inch. The lengths of the strands range from between about 0.25 inches to about 3.0 inches. The packing density is typically between the range of about 100 mg/cm$^3$ to about 300 mg/cm$^3$, and preferably 150 mg/cm$^3$ to about 275 mg/cm$^3$. The cigarettes may also comprise flavorants or other additives known in the art.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

All of the above-mentioned references are herein incorporated by reference in their entirety to the same extent as if each individual reference was specifically and individually indicated to be incorporated herein by reference in its entirety.

What is claimed is:

1. A cigarette comprising a cigarette paper wrapper having heat-degradable filler particles, wherein at least some of the heat-degradable filler particles are completely surrounded by the paper, and wherein said heat-degradable filler particles have a mean average particle size from about 0.05 to about 1 mm and are capable of being dissipated during smoking of the cigarette to increase the porosity of the cigarette paper wrapper.

2. A cigarette of claim 1, wherein the heat-degradable filler particles are capable of being dissipated during smoking of the cigarette and provide the cigarette paper wrapper with a porosity from about 30% to about 60%.

3. A cigarette of claim 1, wherein the heat-degradable filler particles are capable of being dissipated during smoking of the cigarette to provide air dilution of the mainstream smoke of at least about 30 percent.

4. A cigarette of claim 1, wherein the heat-degradable filler particles are capable of being dissipated during smoking of the cigarette to provide air dilution of the mainstream smoke from about 30 percent to about 90 percent.

5. A cigarette of claim 1, wherein the combustion temperature of the cigarette during smoking of the cigarette is maintained from about 600° C. to about 750° C.

6. A cigarette of claim 1, wherein said heat-degradable filler particles are capable of being dissipated at a temperature from about 25° C. to about 350° C.

7. A cigarette of claim 6, wherein said heat-degradable filler particles are capable of being dissipated at a temperature from about 100° C. to about 350° C.

8. A cigarette of claim 7, wherein said heat-degradable filler particles are capable of being dissipated at a temperature from about 200° C. to about 350° C.

9. A cigarette of claim 1, wherein the heat-degradable filler particles comprise an alkyl cellulose, an ethyl cellulose, a cellulose propionate, a cellulose butyrate, a mixed ester of a cellulose, or mixtures thereof.

10. A cigarette of claim 1, wherein the heat-degradable filler particles comprise monosodium phosphate, disodium phosphate, carnauba, polyethylene oxide, vinyl acetate, polymethacrylate, nitrocellulose, ethylene vinyl acetate, or mixtures thereof.

11. A cigarette of claim 1, wherein the heat-degradable filler particles comprise ethyl cellulose, monosodium phosphate, or mixtures thereof.

12. A cigarette of claim 1, wherein the heat-degradable filler particles are capable of being dissipated a distance from about 0.1 mm to about 10 mm or from about 0.5 mm to about 2 mm in advance of a charline, wherein the charline is formed in the cigarette paper wrapper during smoking of the cigarette.

13. A cigarette of claim 1, wherein the heat-degradable filler particles are spheres, pellets, fibers or an irregular shape.

14. A cigarette of claim 1, wherein the heat-degradable filler particles have a mean average particle size from about 0.2 mm to about 0.5 mm.

15. A cigarette comprising a cigarette paper wrapper having heat-degradable filler particles, wherein at least some of the heat-degradable filler particles are completely surrounded by the paper, wherein the heat-degradable filler particles have a mean average particle size from about one quarter the thickness of the cigarette paper wrapper to about one and a half times the thickness of the cigarette paper wrapper and wherein said heat-degradable filler particles are capable of being dissipated during smoking of the cigarette to increase the porosity of the cigarette paper wrapper.

16. A method of making a cigarette, comprising (i) providing a cut filler to a cigarette making machine to form a tobacco rod;

(ii) incorporating heat-degradable filler particles into a cigarette paper wrapper; and (iii) placing the cigarette paper wrapper around the tobacco rod to form the cigarette, wherein said heat-degradable filler particles have a mean average particle size from about 0.05 to about 1 mm and are capable of being dissipated during smoking of the cigarette to increase the porosity of the cigarette paper wrapper.

17. A method of smoking the cigarette of claim 1, comprising lighting the cigarette to form smoke and drawing the smoke through the cigarette, wherein during the smoking of the cigarette, the heat-degradable filler particles are dissipated during smoking of the cigarette to increase porosity of the cigarette paper wrapper.

18. A cigarette paper wrapper comprising heat-degradable filler particles, wherein at least some of the heat-degradable filler particles are completely surrounded by the paper, and wherein said heat-degradable filler particles have a mean average particle size from about 0.05 to about 1 mm and are capable of being dissipated to increase porosity of the cigarette paper wrapper during smoking of a cigarette incorporating the cigarette paper wrapper.

19. A cigarette paper wrapper of claim 18, wherein the heat-degradable filler particles are capable of being dissipated during smoking of the cigarette and provide the cigarette paper wrapper with a porosity from about 30% to about 60%.

20. A cigarette paper wrapper of claim 18, wherein said heat-degradable filler particles are capable of being dissipated at a temperature from about 25° C. to about 350° C.

21. A cigarette paper wrapper of claim 20, wherein said heat-degradable filler particles are capable of being dissipated at a temperature from about 100° C. to about 350° C.

22. A cigarette paper wrapper of claim 21, wherein said heat-degradable filler particles are capable of being dissipated at a temperature from about 200° C. to about 350° C.

23. A cigarette paper wrapper of claim 18, wherein the heat-degradable filler particles comprise an alkyl cellulose, an ethyl cellulose, a cellulose propionate, a cellulose butyrate, a mixed ester of a cellulose, or mixtures thereof.

24. A cigarette paper wrapper of claim 18, wherein the heat-degradable filler particles comprise monosodium phosphate, disodium phosphate, carnauba, polyethylene oxide, vinyl acetate, polymethacrylate, nitrocellulose, ethylene vinyl acetate, or mixtures thereof.

25. A cigarette paper wrapper of claim 18, wherein the heat-degradable filler particles comprise ethyl cellulose, monosodium phosphate, or mixtures thereof.

26. A cigarette paper wrapper of claim 18, wherein the heat-degradable filler particles have a mean average particle size from about 0.2 mm to about 0.5 mm in size.

27. A cigarette paper wrapper comprising heat-degradable filler particles, wherein at least some of the heat-degradable filler particles are completely surrounded by the paper, wherein the heat-degradable filler particles have a mean average particle size from about one quarter the thickness of the cigarette paper wrapper to about one and a half times the thickness of the cigarette paper wrapper and wherein said heat-degradable filler particles are capable of being dissipated to increase porosity of the cigarette paper wrapper during smoking of a cigarette incorporating the cigarette paper wrapper.

28. A method of making the cigarette paper wrapper of claim 18, comprising adding the heat-degradable filler particles to a feedstock of a cigarette paper making machine.

29. A method of claim 28, wherein the heat-degradable filler particles are incorporated in an amount of up to about 50% based on the total weight of the cigarette paper wrapper.

30. A method of claim 29, wherein the heat-degradable filler particles are incorporated in an amount of up to about 30% based on the total weight of the cigarette paper wrapper.

31. A method of claim 28, wherein the heat-degradable filler particles have a mean average particle size from about 0.2 mm to about 0.5 mm.

32. A method of making a cigarette paper wrapper comprising heat-degradable filler particles, comprising adding the heat-degradable filler particles to a feedstock of a cigarette paper making machine, wherein the heat-degradable filler particles have a mean average particle size from about one quarter the thickness of the resulting cigarette paper wrapper to about one and a half times the thickness of the resulting cigarette paper wrapper, at least some of the heat-degradable filler particles are completely surrounded by the paper, and wherein said heat-degradable filler particles are capable of being dissipated to increase porosity of the cigarette paper wrapper during smoking of a cigarette incorporating the cigarette paper wrapper.

33. A method of claim 28, wherein said heat-degradable filler particles are capable of being dissipated at a temperature from about 25° C. to about 350° C.

34. A method of claim 33, wherein said heat-degradable filler particles are capable of being dissipated at a temperature from about 100° C. to about 350° C.

35. A method of claim 34, wherein said heat-degradable filler particles are capable of being dissipated at a temperature from about 200° C. to about 350° C.

36. A cigarette comprising a cigarette paper wrapper having heat-degradable filler particles, wherein said cigarette paper wrapper is free of perforations prior to smoking of the cigarette and wherein said heat-degradable filler particles have a mean average particle size from about 0.05 to about 1 mm and are capable of being dissipated during smoking of the cigarette to increase the porosity of the cigarette paper wrapper.

37. A cigarette of claim 36, wherein the heat-degradable filler particles are capable of being dissipated during smoking of the cigarette and provide the cigarette paper wrapper with a porosity from about 30% to about 60%.

38. A cigarette of claim 36, wherein the heat-degradable filler particles are capable of being dissipated during smoking of the cigarette to provide air dilution of the mainstream smoke from about 30 percent to about 90 percent.

39. A cigarette of claim 36, wherein the combustion temperature of the cigarette during smoking of the cigarette is maintained from about 600° C. to about 750° C.

40. A cigarette of claim 36, wherein said heat-degradable filler particles are capable of being dissipated at a temperature from about 25° C. to about 350° C.

41. A cigarette of claim 36, wherein the heat-degradable filler particles comprise an alkyl cellulose, an ethyl cellulose, a cellulose propionate, a cellulose butyrate, a mixed ester of a cellulose, or mixtures thereof.

42. A cigarette of claim 36, wherein the heat-degradable filler particles comprise monosodium phosphate, disodium phosphate, carnauba, polyethylene oxide, vinyl acetate, polymethacrylate, nitrocellulose, ethylene vinyl acetate, or mixtures thereof.

43. A cigarette of claim 36, wherein the heat-degradable filler particles are capable of being dissipated a distance from about 0.1 mm to about 10 mm in advance of a charline, wherein the charline is formed in the cigarette paper wrapper during smoking of the cigarette.

44. A cigarette of claim 36, wherein the heat-degradable filler particles are spheres, pellets, fibers or an irregular shape.

45. A cigarette of claim 36, wherein the heat-degradable filler particles have a mean average particle size from about 0.2 mm to about 0.5 mm.

46. A cigarette comprising a cigarette paper wrapper having heat-degradable filler particles, wherein said cigarette paper wrapper is free of perforations prior to smoking of the cigarette, wherein the heat-degradable filler particles have a mean average particle size from about one quarter the thickness of the cigarette paper wrapper to about one and a half times the thickness of the cigarette paper wrapper wherein said heat-degradable filler particles are capable of being dissipated during smoking of the cigarette to increase the porosity of the cigarette paper wrapper.

47. A cigarette paper wrapper comprising heat-degradable filler particles, wherein said cigarette paper wrapper is free of perforations and wherein said heat-degradable filler particles have a mean average particle size from about 0.05 to about 1 mm and are capable of being dissipated to increase porosity of the cigarette paper wrapper during smoking of a cigarette incorporating the cigarette paper wrapper.

48. A cigarette paper wrapper of claim 47, wherein the heat-degradable filler particles are capable of being dissipated during smoking of the cigarette and provide the cigarette paper wrapper with a porosity from about 30% to about 60%.

49. A cigarette paper wrapper of claim 47, wherein said heat-degradable filler particles are capable of being dissipated at a temperature from about 25° C. to about 350° C.

50. A cigarette paper wrapper of claim 47, wherein the heat-degradable filler particles comprise an alkyl cellulose, an ethyl cellulose, a cellulose propionate, a cellulose butyrate, a mixed ester of a cellulose, or mixtures thereof.

51. A cigarette paper wrapper of claim 47, wherein the heat-degradable filler particles comprise monosodium phosphate, disodium phosphate, carnauba, polyethylene oxide, vinyl acetate, polymethacrylate, nitrocellulose, ethylene vinyl acetate, or mixtures thereof.

52. A cigarette paper wrapper of claim 47, wherein the heat-degradable filler particles have a mean average particle size from about 0.2 mm to about 0.5 mm.

53. A cigarette paper wrapper comprising heat-degradable filler particles, wherein said cigarette paper wrapper is free of perforations and wherein the heat-degradable filler particles have a mean average particle size from about one quarter the thickness of the cigarette paper wrapper to about one and a half times the thickness of the cigarette paper wrapper and are capable of being dissipated to increase porosity of the cigarette paper wrapper during smoking of a cigarette incorporating the cigarette paper wrapper.

* * * * *